US009143863B2

(12) United States Patent
Poulsen et al.

(10) Patent No.: US 9,143,863 B2
(45) Date of Patent: Sep. 22, 2015

(54) APPARATUS, SYSTEMS AND METHODS FOR INAUDIBLY IDENTIFYING AN AUDIO ACCESSORY USING SPECTRAL SHAPING

(71) Applicant: BLACKBERRY LIMITED, Waterloo (CA)

(72) Inventors: Jens Kristian Poulsen, Kitchener (CA); Yong Zhang, Waterloo (CA)

(73) Assignee: BLACKBERRY LIMITED, Waterloo (CA)

( * ) Notice: Subject to any disclaimer, the term of this patent is extended or adjusted under 35 U.S.C. 154(b) by 338 days.

(21) Appl. No.: 13/756,979

(22) Filed: Feb. 1, 2013

(65) Prior Publication Data

US 2014/0219463 A1 Aug. 7, 2014

(51) Int. Cl.
*H04R 29/00* (2006.01)
*H04R 5/04* (2006.01)

(52) U.S. Cl.
CPC ..... *H04R 5/04* (2013.01); *H04R 2420/05* (2013.01)

(58) Field of Classification Search
CPC ..... H04R 29/00; H04R 5/04; H04R 2420/05
USPC ..... 381/58, 74, 80, 81, 85, 111, 122, 123; 710/300, 302, 304; 455/557, 575.2, 455/556.1, 569.1
See application file for complete search history.

(56) References Cited

U.S. PATENT DOCUMENTS

| | | | | |
|---|---|---|---|---|
| 2005/0201568 | A1* | 9/2005 | Goyal | 381/74 |
| 2006/0104453 | A1 | 5/2006 | Lee et al. | |
| 2007/0049103 | A1* | 3/2007 | Kashi et al. | 439/396 |
| 2007/0147640 | A1* | 6/2007 | Mottier et al. | 381/111 |
| 2008/0164994 | A1* | 7/2008 | Johnson et al. | 340/533 |
| 2008/0318629 | A1* | 12/2008 | Inha et al. | 455/557 |
| 2010/0215183 | A1* | 8/2010 | Hansson et al. | 381/58 |
| 2012/0134503 | A1 | 5/2012 | Poulsen et al. | |
| 2012/0265911 | A1* | 10/2012 | Connolly | 710/300 |
| 2013/0108063 | A1* | 5/2013 | Verhoeve et al. | 381/58 |

FOREIGN PATENT DOCUMENTS

EP 2224749 A1 9/2010

OTHER PUBLICATIONS

Counterpart European Patent Application No. 13153735.9, "Extended European Search Report" issued Aug. 30, 2013.

* cited by examiner

*Primary Examiner* — Vivian Chin
*Assistant Examiner* — Friedrich W Fahnert
(74) *Attorney, Agent, or Firm* — Perry + Currier Inc.

(57) ABSTRACT

A method for identifying an accessory coupled to an electronic device. The method includes applying at least one detection pulse to the audio accessory, each detection pulse being spectrally shaped to be generally inaudible to a human user, receiving at least one response signal corresponding to each detection pulse that is indicative of the impedance of the accessory, and based on the impedance, identifying the accessory.

20 Claims, 12 Drawing Sheets

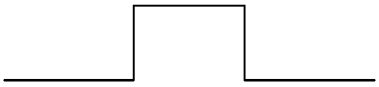

Unipolar rectangular
$\mathrm{Rect}(t/T) \leftrightarrow T\mathrm{sinc}(fT)$

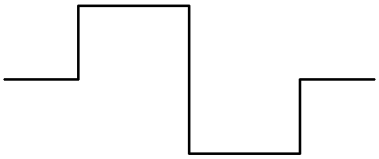

Bipolar rectangular
$\mathrm{Rect}(t/T+½)-\mathrm{Rect}(t/T-½) \leftrightarrow$
$j2T\mathrm{sinc}(fT)\sin(\pi fT)$

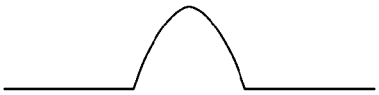

Unipolar sinusoidal
$\mathrm{Rect}(t/T)(\cos \pi t/T) \leftrightarrow$
$½T[\mathrm{sinc}(T(f+½f_0))+\mathrm{sinc}(T(f-½f_0))]$

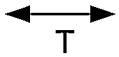

N pulses?

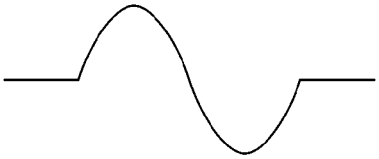

Bipolar sinusoidal
$-\mathrm{Rect}(t/2T)(\sin \pi t/T) \leftrightarrow$
$jT[\mathrm{sinc}(T(2f-f_0)-\mathrm{sinc}(T(2f+f_0))]$

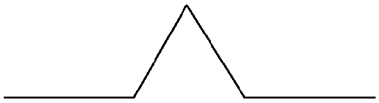

Triangular
$\Lambda(t/T) \leftrightarrow T\mathrm{sinc}^2(fT)$

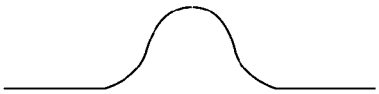

Blackman-Harris window
(first sidelobe is - 92 dB down)

FIG. 11

APPARATUS, SYSTEMS AND METHODS FOR INAUDIBLY IDENTIFYING AN AUDIO ACCESSORY USING SPECTRAL SHAPING

FIELD

Embodiments herein relate to electronic devices and audio accessories, and in particular to apparatus, systems and methods for identifying an audio accessory, such as a headset, coupled to an electronic device.

INTRODUCTION

Electronic devices, including portable electronic devices like smart phones, tablet computers, media players, and so on have gained widespread use and may provide a variety of functions including playing media (e.g., music and movies), and in some cases telephonic services, text messaging, web browsing and other data applications.

Electronic devices are often used with audio accessories such as headsets. For example, some electronic devices have audio jacks that are sized and shaped to receive a mating plug from a headset. A user can connect the headset to the electronic device by inserting the plug on the headset into the audio jack on the electronic device. Once connected, audio can be output to the user via speakers on the audio accessory.

In some cases, an audio accessory may incorporate a microphone to allow audio signals (e.g., speech) to be sent from the audio accessory to the electronic device. This may allow the user to make phone calls through the audio accessory, record voice memos, control the electronic device using voice commands, and so on.

In some cases, an audio accessory may include one or more buttons or other input devices to control the electronic device.

DRAWINGS

For a better understanding of the embodiments described herein, and to show how they may be carried into effect, reference will now be made, by way of example, to the accompanying drawings.

FIG. 11 is a schematic showing various waveforms; and

DESCRIPTION OF VARIOUS EMBODIMENTS

Figure 1:
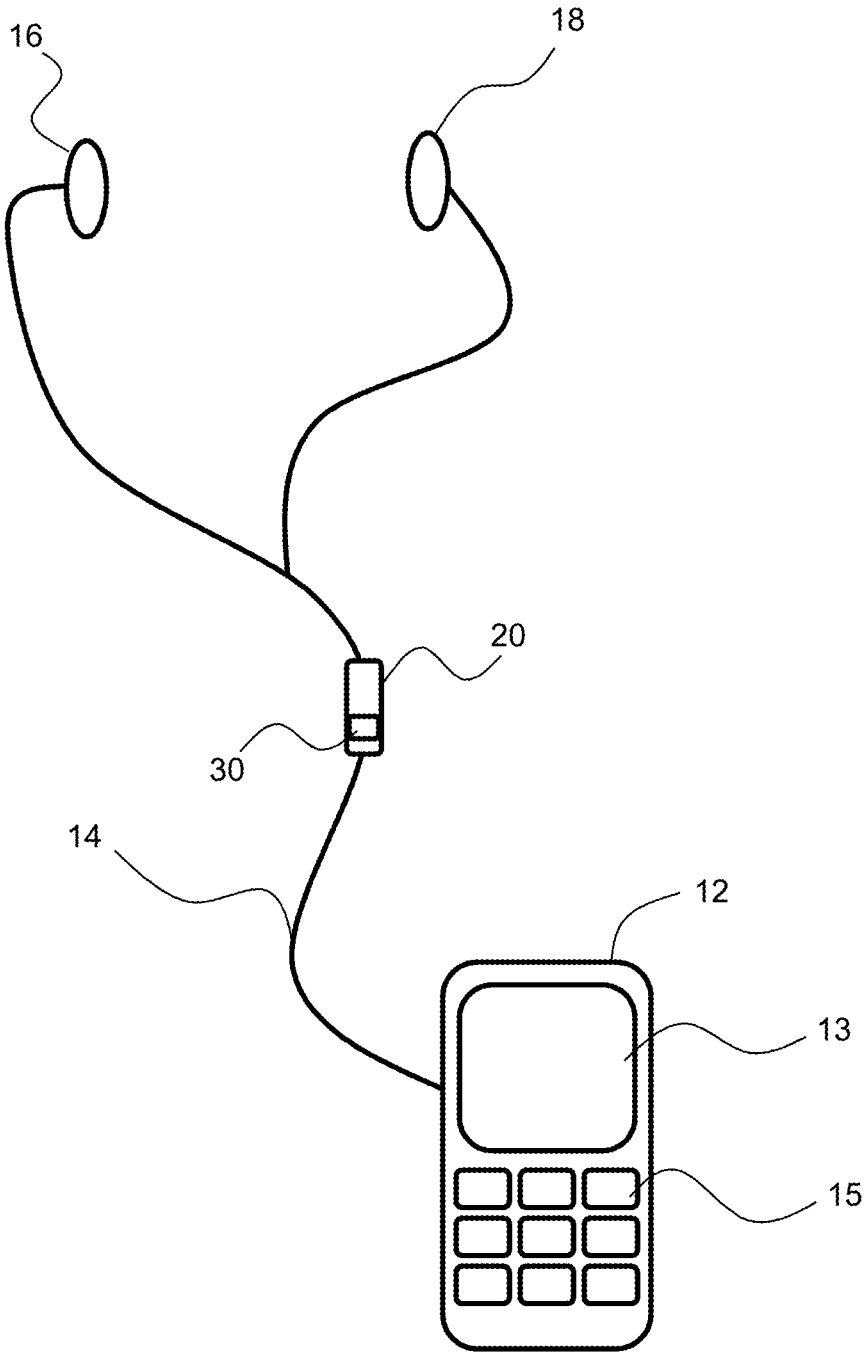
FIG. 1 is a schematic representation of an electronic device and an audio accessory according to one embodiment.

Generally, some embodiments as described herein may be implemented on electronic devices, which may include a wide range of portable devices that can be worn or carried by a human user, such as mobile phones, smart phones, personal digital assistants (PDAs), notebooks, laptops, digital audio/video players, digital audio/video recorders, tablet computers, portable computers, music or media players, tablet computers, GPS devices and the like. Some of these portable electronic devices may be handheld, that is, they may be sized and shaped to be held or carried in a human hand, and may be used while so held or carried.

In some embodiments, electronic devices may also include devices that are normally not worn or carried by a human user, for example a desktop computer, a stereo system, a vehicle audio system, and so on.

On some of these electronic devices, especially portable electronic devices, computer resources (e.g., memory capacity, processing power, and screen space) may be more limited than on other devices. A smart phone, for example, may have a smaller display and less memory capacity than a desktop computer, which may have a larger display and more memory.

In some embodiments, the electronic device may be a portable electronic device that has voice communication capabilities or data communication capabilities (or both), over one or more data connections (e.g., a wireless connection).

As used herein, the term "audio accessory" may include any accessory (such as a supplemental device or add-on or other device that works in concert with the electronic device) and that manages, controls, processes or otherwise operates with audio signals. Examples of audio accessories may include headphones, speakers, microphones, sound recorders, or accessories that incorporate one or more of such things.

According to context, an audio accessory may be coupled to an electronic device physically, electronically, communicatively, or some combination thereof. In one example, insertion of a plug on a headset into an audio jack of a media player may physically, electronically and communicatively couple the media player and headset together, in that they can behave like a unified object, they can send or receive electrical signals with respect to one another, and they can communicate with one another.

The concepts as described herein are not necessarily limited to any particular kind of electronic device or audio accessory, but are generally suitable for use on various electronic devices with various computer resources and with various audio accessories.

As used herein, the term "inaudible" generally includes both totally inaudible and substantially inaudible. Specifically, the term "inaudible to a human" refers to sounds or frequency components that are outside the range of ordinary human hearing, as well as sounds or frequency components that are negligible to an ordinary human being. Furthermore, references to an energy content that is below an audible frequency range should be understood as referring to energy content that is totally below an audible frequency range as well as energy content that is substantially below an audible frequency range. Similarly, references to the exclusion of energies above a lower audible human threshold and the like should be interpreted as referring to the total exclusion of energies above a lower audible human threshold as well as to the substantial exclusion of energies above a lower audible human threshold.

Reference is now made to FIG. 1, which is a schematic diagram illustrating an electronic device 12 and an audio accessory 14 according to one embodiment.

The electronic device 12 may include any suitable electronic device, such as a portable smart phone having a display 13 and a physical keyboard 15 (as shown). In some embodiments, the electronic device 12 may include a touchscreen device, optionally with or without a keyboard.

In this embodiment the audio accessory 14 is a headset having two speakers (e.g., speakers 16, 18), although in other embodiments a different number of speakers could be present. The speakers 16, 18 of the accessory 14 are generally operable to output audio content, such as music, speech, and so on. In this embodiment, the audio accessory 14 also includes a user control interface 20 for controlling aspects of the electronic device 12 (e.g., for adjusting audio volume, changing music tracks, etc.).

In some embodiments, the audio accessory 14 may include a microphone 30 for receiving audio signals (e.g., a user's voice) and for sending those audio signals to the electronic device 12. As shown, in some embodiments the microphone 30 may be provided with the user control interface 20. Alternatively, the microphone 30 may be provided at another location on the audio accessory 14.

In some embodiments, the audio accessory 14 is connected to the electronic device 12 using a conventional audio plug on the audio accessory 14 that mates with a corresponding audio jack on the electronic device 12.

In some embodiments, the plug and jack can be of the tip-ring-sleeve (TRS) variety, a tip-ring1-ring2-sleeve (TRRS) variety, or other various types. For example, some audio connectors are in the form of 3.5 mm (⅛") miniature plugs and jacks, or other sizes such as 2.5 mm connectors and ¼" connectors. In headsets and other audio accessories, these audio connectors are generally used to carry audio signals and other information between the speakers 16, 18, the microphone 30 and the electronic device 12.

In some cases, it may be desirable to detect or identify information about the particular audio accessory 14 that is coupled to the electronic device 12. For example, different audio accessories, particularly audio accessories from different manufacturers, may have different pin configurations (e.g., TRS vs. TRRS), different control interfaces 20, may or may not have a microphone 30, may have varying audio capabilities (including volume ranges), or in general may have other differences that affect their performance and functionality when coupled to the electronic device 12.

Determining which particular audio accessory 14 is coupled to the electronic device 12 can allow the electronic device 12 to make changes to compensate for or take advantage of the differences between audio accessories. For instance, different functions on the electronic device 12 may be activated or deactivated depending on which audio accessory 14 is connected (e.g., whether or not a microphone 30 is present).

In some cases both a ground terminal placed at either RING2 or SLEEVE on a TRRS jack may be detected and supported to enable compatibility with a wider range of accessories. As another example, different audio output profiles might be used for audio accessories with different audio capabilities (e.g., mono, stereo), and so on.

To determine what particular audio accessory is connected to the electronic device, various detection techniques can be employed, which can include making one or more electrical measurements of the accessory.

For instance, one approach to identification of audio accessories is to measure the impedance of the audio accessory. Impedance tends to vary between different audio accessories, but is usually relatively constant for a particular brand or type of audio accessory. Thus an impedance measurement can provide a relatively reliable "fingerprint" of the audio accessory type or brand (or both).

In one example, the impedance of the audio accessory 14 can be measured by applying a voltage (e.g., a detection pulse, such as a +100 mV pulse) to at least one of the pin connectors of the accessory while making a current return path available on at least one other pin. The response of the audio accessory to this voltage can then be measured and used to determine an impedance value for that audio accessory.

The measured impedance value can then be compared to a list of known impedances corresponding to particular audio accessories. For example, a table of audio accessories and their associated impedances could be stored on the electronic device 12 (e.g., in a memory or a database), downloaded from a webserver, and so on.

Unfortunately, in some instances at least partly due to the widely varying range of sensitivity and impedance of different audio accessories, it can be difficult to measure impedance without introducing audio disturbances or artifacts during the detection process. These disturbances can manifest themselves as clicks, noises, beeps, pops and various other audio artifacts that can impair the user experience during detection of the audio accessory.

Furthermore, in order to make the detection robust and provide a relatively accurate determination of audio accessory type or brand, detection techniques are often repeated many times to validate the results. For example, depending on the desired level of certainty (e.g., less than a 0.01% probability of a false detection result), a detection pulse may be applied to the audio accessory two, three or many more times in order to verify what particular audio accessory has been detected. In some cases, this repetition may be done by hardware (e.g., at chip level), by software, or some combination thereof.

Unfortunately, repeatedly using a detection pulse to check the audio accessory impedance can cause repeated instances of undesirable audio disturbances. Accordingly, a trade-off seems to exist between obtaining an accurate determination of what audio accessory is connected to the electronic device and introducing a number of undesirable audio artifacts.

To try to avoid audio artifacts but still reliably identify the accessory, several approaches have been developed that are based on modifying or shaping the detection pulse as discussed herein.

It is first noted that the human auditory system is normally sensitive to frequencies from about 20 Hz to around 20,000 Hz (20 kHz), which is defined herein as the "human audible frequency range" (although this range can vary somewhat between different humans). Audio artifacts will generally only be audible to a human being when they fall within the human audible frequency range, or in the special case of amplitude limited pressure conditions which will not be considered here.

Thus, one approach to avoiding audible artifacts is to shape detection pulses so that the energy content is mostly located at low frequencies that are inaudible to humans (e.g., at frequencies less than 20 Hz), thus at least substantially excluding frequency components within the human audible frequency range (generally meaning that at least a substantial portion of the frequencies components within the human audible frequency range are excluded, and in some cases all frequency components within that range may be suppressed).

The impedance response of an audio accessory to this low frequency detection pulse can then be measured without normally introducing substantial audio artifacts. For instance, in some examples, this approach may involve using detection pulses with frequencies at around 10 Hz or less. This approach can also be referred to as using a "slow detection pulse".

However, since any finite pulse length will have a broad energy spectrum (as evidenced by Fourier analysis), any detection pulse, even a slow detection pulse, will have some spectral leakage above the 20 Hz lower limit of the human audible frequency range. Nevertheless, with a properly designed detection pulse it should be possible to control this spectral leakage and keep at least a substantial portion of the energy content below the human audible frequency range and thereby make a slow detection pulse at least substantially inaudible.

Unfortunately, using a slow detection pulse has some problems. In particular, because of the low frequencies, identifying an audio accessory using this approach can take a very long time (relatively speaking). For example, in some cases, it may take several seconds to accurately identify an audio accessory using a low frequency pulse, particularly when several detection pulses are sent to validate results. This delay can be noticeable to a user, and may lead to undesirable performance.

Moreover, when the audio accessory includes an AC-coupled load (e.g., a LINE IN connection, such as a capacitively connected input to an audio amplifier system), the detection of that load may be difficult (or even impossible) using low frequency detection pulses since impedance is measured in a frequency range where the load (i.e. the combination of an input capacitor and the input impedance of the amplifier itself) is very high. This tends to make the determination of the impedance inaccurate.

Accordingly, using a low frequency detection pulse may not always be suitable for detecting audio accessories and can lead to inaccurate results, particularly where it is not supplemented by other methods.

Figure 5:
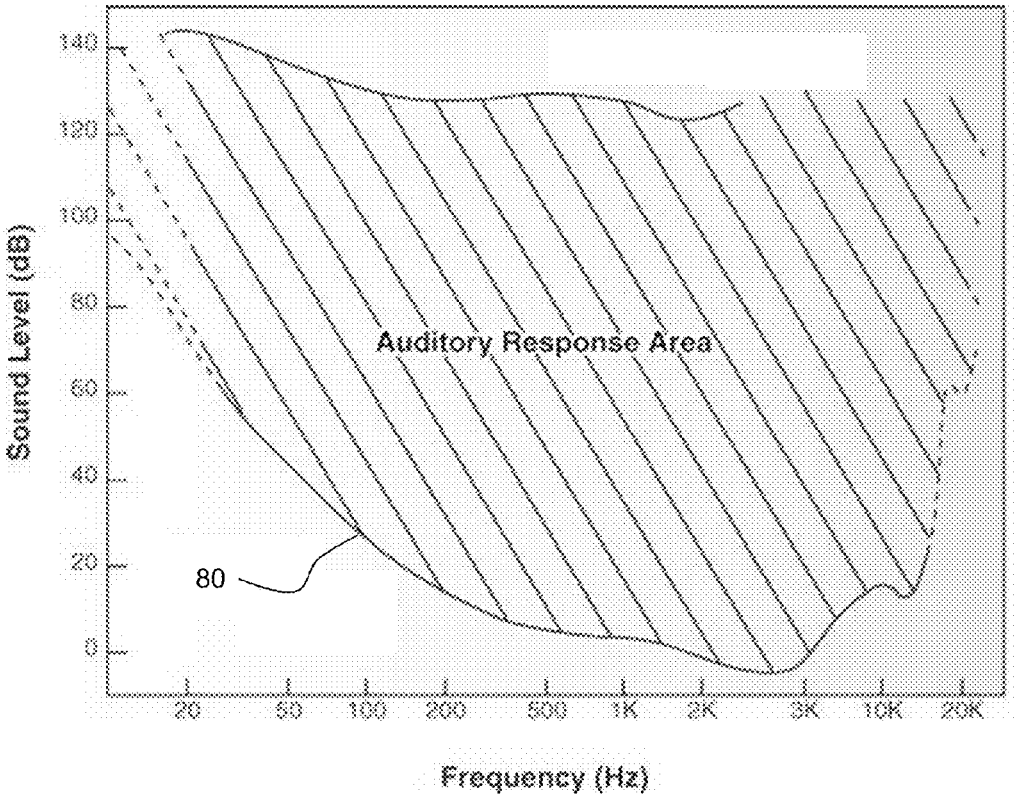
FIG. 5 is a schematic representation of human audibility at various frequencies and sound intensity levels.

It will now be noted that within the human audible frequency range, there is a minimum threshold amplitude below which a sound normally cannot be detected. For instance, FIG. 5 shows a sensitivity map of the human auditory response based on human hearing range research of the audible frequency range. A lower audible threshold curve 80 defines the minimum audibility curve for an average human. Sounds below this curve 80 normally cannot be perceived (subject to variability for different individuals with very good or very poor hearing).

A second approach to avoiding audio artifacts therefore involves applying a detection pulses that are shaped to have a sufficiently low amplitude such that that the energies of the detection pulse are at least substantially below the lower audible human threshold for hearing, thus at least substantially excluding energies that are above the lower audible human threshold (generally meaning that at least a substantial portion of the energies above the lower audible human threshold are suppressed, and in some cases all the energies above that threshold are excluded).

This approach can be used even though the detection pulse may include energies located within the human audible frequency range (e.g., between 20 Hz and 20 kHz) so long as the amplitudes are sufficiently low. This approach may be faster than using a low frequency detection pulse since the frequency of the detection pulse can be higher.

In order for the detection pulses to be inaudible for most human individuals, including individuals with good hearing, some tolerance may be given to account for variability of the lower detection threshold. Accordingly, in some embodiments using this approach the energy of the detection pulse may be more than some particular amount below the lower audible threshold curve (for example, the energy of the detection pulse could be shaped to be at least 10 dB less that the lower audible threshold curve).

One challenge with this approach to avoiding audio artifacts is that the low energy (low amplitude) signals can be highly susceptible to noise (e.g., these signals often have a poor signal-to-noise ratio). This may lead to less accurate readings, or at least require multiple detection pulses to validate the result, which can slow the detection process when using this approach.

Figure 9:
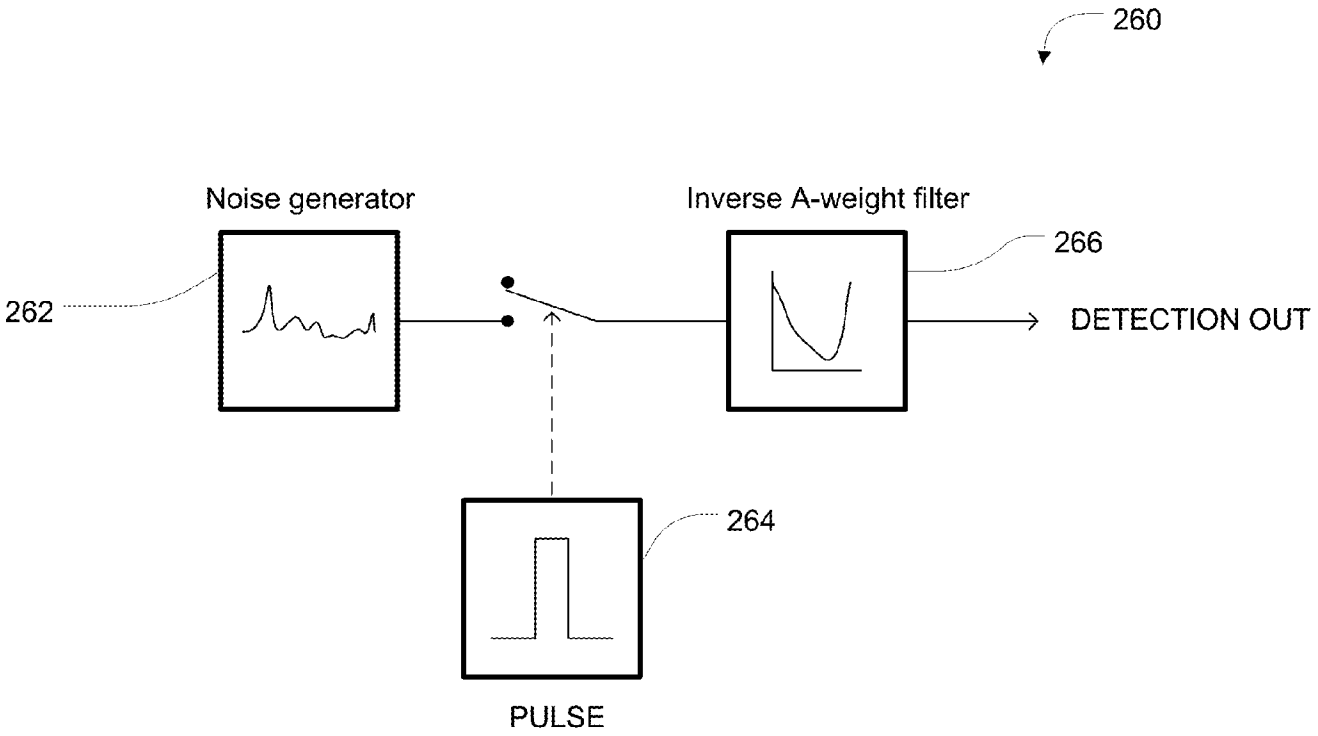
FIG. 9 is a schematic of a method of spectrally shaping a detection pulse using pseudorandom modulation.

In some cases, a noise-like signal shaped to be below the lower audible threshold curve may be used for some period of time in order to get a sufficiently good signal-to-noise ratio and still be able to detect impedances in which AC-coupled loads do not present any problems. For instance, as shown in FIG. 9, according to one method 260 the detection pulse (e.g., detection pulse 264) could be a spectrally shaped voltage pulse driven by a pseudorandom noise generator (e.g., the noise generator 262) and then shaped with an inverse filter (e.g., the filter 266 as shown). The detected response signal could then be integrated using the pseudorandom noise generator as reference for a cross-correlation measurement of the impedance value (see for example FIG. 10).

A third approach to avoiding audible artifacts involves using shaped detection pulses with a spectral content that is above the audible frequency range (e.g., a high-frequency detection pulse above 20 kHz) so that the pulse is generally inaudible to a human being (thus at least substantially excluding frequency components within the human audible frequency range).

This approach may allow accessory detection to be very fast. Furthermore, higher frequency detection pulses tend to be good at detecting AC-coupled loads since any input coupling capacitors will tend not disturb the impedance measurements at these frequencies. This approach also tends to have a good signal-to-noise ratio and thus be resistant to noise since the energy levels of the detection pulse can be relatively high.

However, if the load includes some capacitance in parallel with the load (e.g., a capacitor in parallel with a microphone), then this type of measurement will tend to become less and less accurate as higher frequencies are used (unless a more complicated measurement of the complex impedance is performed, in which case it may be possible to distinguish between the imaginary and real impedance part).

Therefore, the use of very high frequencies (e.g. above 100 kHz) should likely be used only when the effects of parasitic capacitance and inductance will not significantly affect the measurement, or when a more complicated complex impedance measurement is possible (however this may be prohibitive due to cost reasons).

In some cases, it may be possible to avoid or at least suppress the influence of capacitance and inductance in parallel with the load when the measurement is taken at a finite time after the excitation pulse has changed (i.e. an initial transient has died out) thereby making the measurement generally immune to these effects. In some embodiments, this can be accomplished by having the detection pulse stable for at least 12 microseconds (or even 15 microseconds or more), which fits nicely with a 32.768 kHz clock oscillator that may be present on many electronic devices. In this configuration, the sampling of one or more values should first be undertaken after the detection pulse is stable for this finite amount of time.

In some cases, the capacitance in series with the load will still conduct current after the initial transient has died out, since the RC-constant for a LINE IN connection is typically below 20 Hz, or significantly below the frequency of operation.

However, if the sampling event is instead chosen to be just at the onset of the initial transient, a measurement of the combined resistance and capacitance can be made, after which the capacitance can be estimated by subtracting the resistance.

Figure 12:
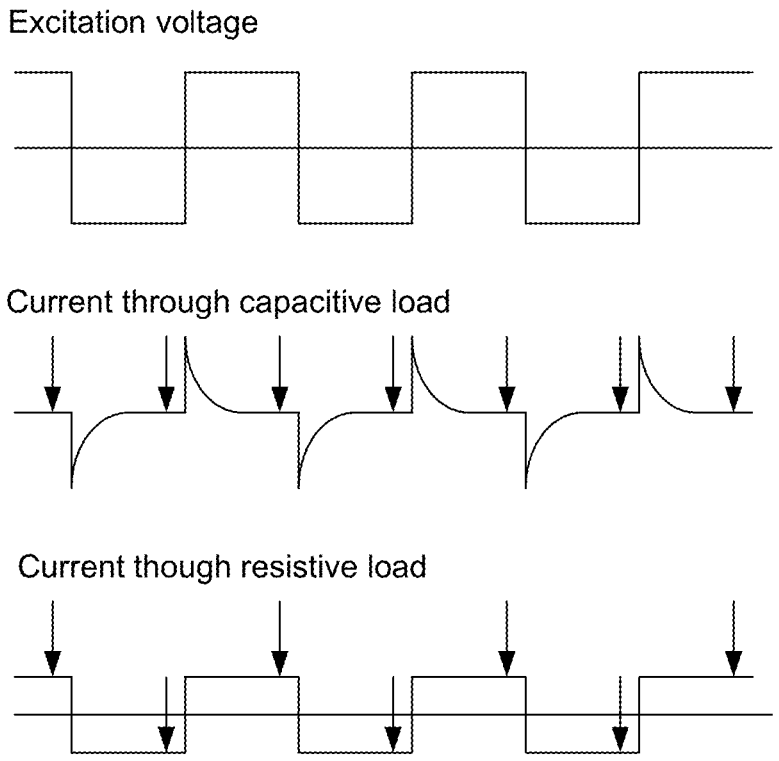
FIG. 12 is a schematic showing current responses to a capacitive and resistive load wherein currents from parasitic capacitance may be avoided or at least inhibited by selective sampling.

For example, FIG. 12 shows how currents from parasitic capacitance may be avoided by careful sampling at specific times. This approach might be used to detect the presence and polarity of an attached cable.

Furthermore, due to the higher impedances involved when measuring on LINE loads (e.g., 10 k-47 kOhm), a detection pulse with a high amplitude is often used. If such a high amplitude detection pulse is applied directly to a low impedance load, such as a low impedance (e.g., 32 Ohm) sensitive audio accessory (e.g., headphones), large clicks or other audio artifacts might be heard by a user unless precautions are taken to limit the spectral leakage from the detection pulse so it does not appear within the human audible frequency range.

Moreover, this approach may be problematic with some headphones or other accessories that contain active signal conditioning circuits. In such cases, the active electronics may present an impedance that varies with frequency (e.g., input filters). Thus, the measured impedance at a high frequency outside the human audible frequency range may not be the same value as the impedance within the human audible frequency range.

For all three approaches to avoiding audio artifacts, it may be desirable to shape the spectrum of the emitted detection pulse to try and eliminate at least some audible artifacts.

For example, when using a slow detection pulse, the spectral leakage from the lower frequencies to higher audible frequencies could be limited to suppress audible artifacts. In some embodiments, spectral leakage can be limited by using a detection pulse with a known low leakage (such as a sinc-shaped pulse) that is combined with a known good windowing function (such as a Gaussian, flat-top or Blackman-Harris type windowing function, as shown in FIG. 11 for example).

The desired spectral characteristics of the leaked energy inside the human audible frequency range may determine the dynamic range of the output pulse and the attenuation needed to suppress audible artifacts.

With the second approach to avoiding audible artifacts, the audibility of the detection pulse could be limited by spectral shaping. As a first example, a noise generator with flat spectral characteristics may be used to generate the detection pulse. However, before emitting the pulse, the pulse may be attenuated with a transfer function that is generally the opposite of the human hearing ability (e.g., the opposite of the curve 80 as shown in FIG. 5).

In this way it should possible to transfer a significant amount of energy within the human audible frequency range without the detection pulse being audible to most human beings. Moreover, this should allow detection of the audio accessory to be achievable within a very small amount of time.

In the third approach (using a high-frequency detection pulse), to suppress artifacts short detection pulses can used with an envelope that minimizes the spectral leakage within the human audible frequency range (or at least limits the spectral leakage so that the detection pulses are substantially inaudible).

In various embodiments, shaping the detection pulse can be done using different techniques.

In one embodiment, a special spectrally shaped detection pulse can be stored in hardware and generated on command (i.e. as a particular voltage pattern). This sequence can then be sent to the audio accessory as a special inaudible waveform when desired.

In some embodiments, an inaudible waveform can be stored in a ROM or implemented as an algorithm (e.g., a triangular generator) and controlled by a counter. The output coefficients could be fed to a DAC (digital to analog converter) or they could be directly implemented using variable size resistors or capacitors that (in an analog fashion) implement the waveform shape thereby eliminating the need for a DAC.

When implementing a generally inaudible waveform that exploits the low audibility of low frequencies (e.g., frequencies below the limit of human hearing) the pulse waveform should be implemented correctly. For example, the waveshape chosen can be a window function such as a triangular, Gaussian, Blackman-Harris or some other window shape with known good attenuation of sidelobes and low spectral leakage.

Figure 6:
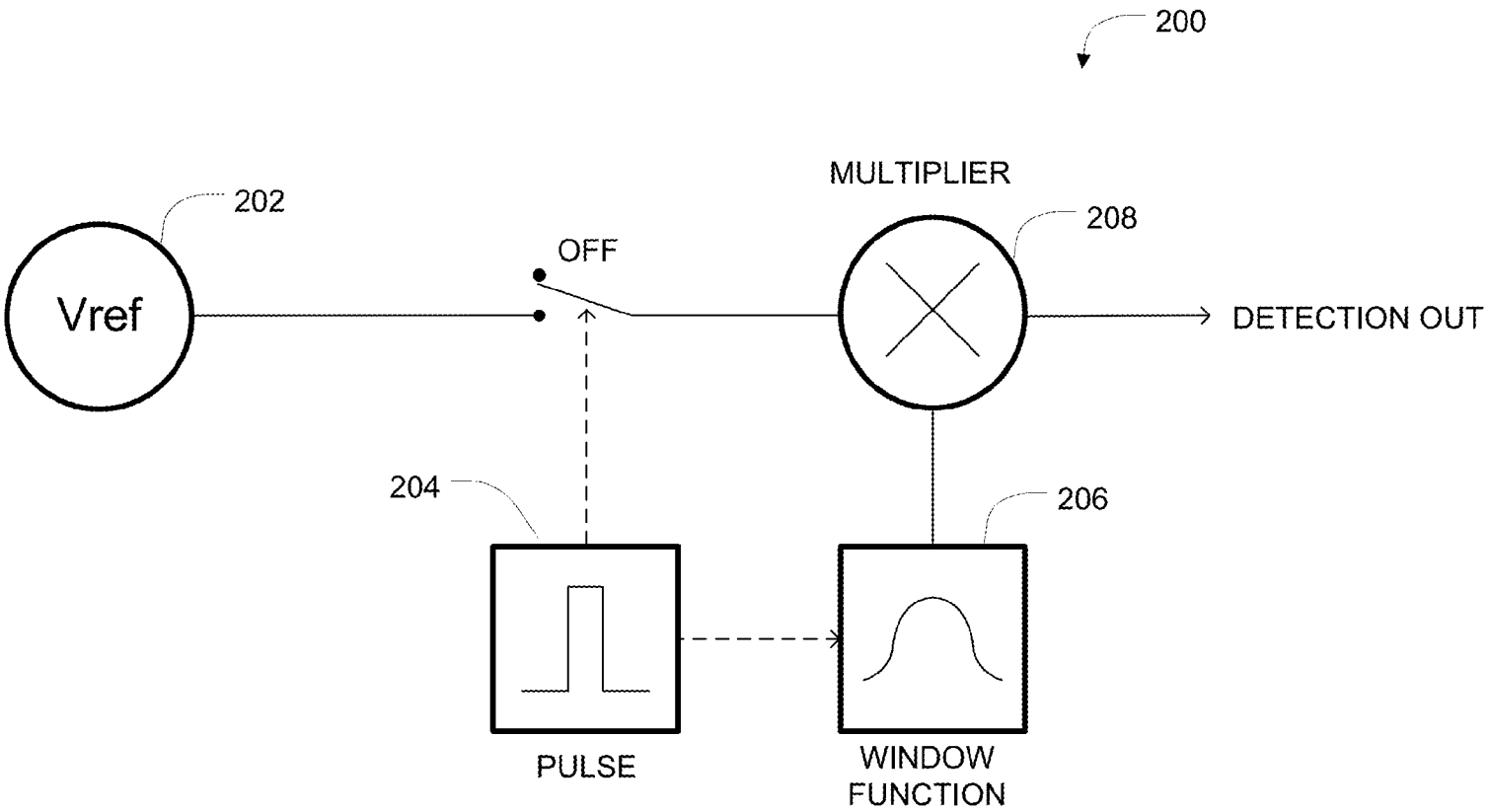
FIG. 6 is a schematic of a method of spectrally shaping a detection pulse using a window function.

For example, as shown in FIG. 6, in one method 200 a DC voltage source 202 can be used to generate a raw detection pulse 204, which is then subjected to a window function 206. The resulting signals can be multiplied using a multiplier 208 and then outputted as a generally inaudible detection pulse which is sent to the audio accessory.

Furthermore, some attention should be paid to the discretized values since otherwise this may result in audible noise. As an example, the use of a triangular window and a low number of discretized steps to represent a waveform may result in audible tones, since this waveform can be represented as the addition of a perfect triangular waveform superimposed with a high frequency square wave with an amplitude equal to the discretization steps. This may be audible due to the high sensitivity to tones of the human ear.

Therefore, if a sufficient number of steps are not available as the output from a particular window function, dithering (or an output filter) may be used after the window function. In other cases, noise shaping may be used thereby pushing the quantization noise out of the audible range to avoid the effects of quantization. Alternatively, in some other cases the window function may be implemented using an analog circuit without any steps (e.g., to charge and discharge a capacitor at a controlled rate).

When sending out pulses that are located in the audible band (e.g., between 20 Hz to 20 kHz) particular attention should be paid to the sections of the band where the human ear is the most sensitive. Therefore, in some cases either the pulse should be attenuated in this band as much as possible or a pulse should either be located below or above the most sensitive parts of the spectrum (or both).

Furthermore, and in order to get reasonable detection times with this approach, it may be beneficial to emit broadband noise as a detection pulse, thereby distributing the energy into multiple bands.

An example of a suitable weighting curve for this method is the inverse of the A-weighting curve (e.g., filter 266 shown in FIG. 9) that may be used in order to send out more energy in the energy bands where the human ear is less sensitive. Accordingly it should be possible to emit a considerable amount of energy within a limited time and make this detection pulse at least substantially inaudible to a human being.

One example of a spectrally shaped pulse, a unipolar pulse as shown in FIG. 11, can be compared to a bipolar pulse. A unipolar pulse with a duration of T will have an energy peak at DC and a null at 1/T. This pulse can be represented in the frequency domain as a T sin c(fT) function and has wide leakage. On FIG. 11, T=1/32768, although in other embodiments other values for T could be used.

The spectrum of this pulse will be almost flat at low frequencies, though if it is A-weighted, there will be a large decrease at the lowest frequencies due to the poorer sensitivity of the ear.

The bipolar pulse with duration of T can be represented in the frequency domain as $j2T\mathrm{sinc}(fT)\sin(\pi fT)$. The spectral leakage will be lower since this pulse has no DC-component. Therefore if this pulse is made sufficiently quick it will be inaudible to a human being.

However, due to the finite settling time of some audio accessories, there are normally limits to how short the detection pulse can be made. In some cases, further improvement can be obtained by changing the window function from a rectangular window to another window function with better spectral characteristics (and in some cases including multiple periods) before applying the window function. Additional examples are provided in FIG. 11, including a unipolar sinusoidal pulse, and a bipolar sinusoidal pulse. In particular, it should be noted that neither of the bipolar pulses (either rectangular or sinusoidal) will have a DC-component.

Figure 7:
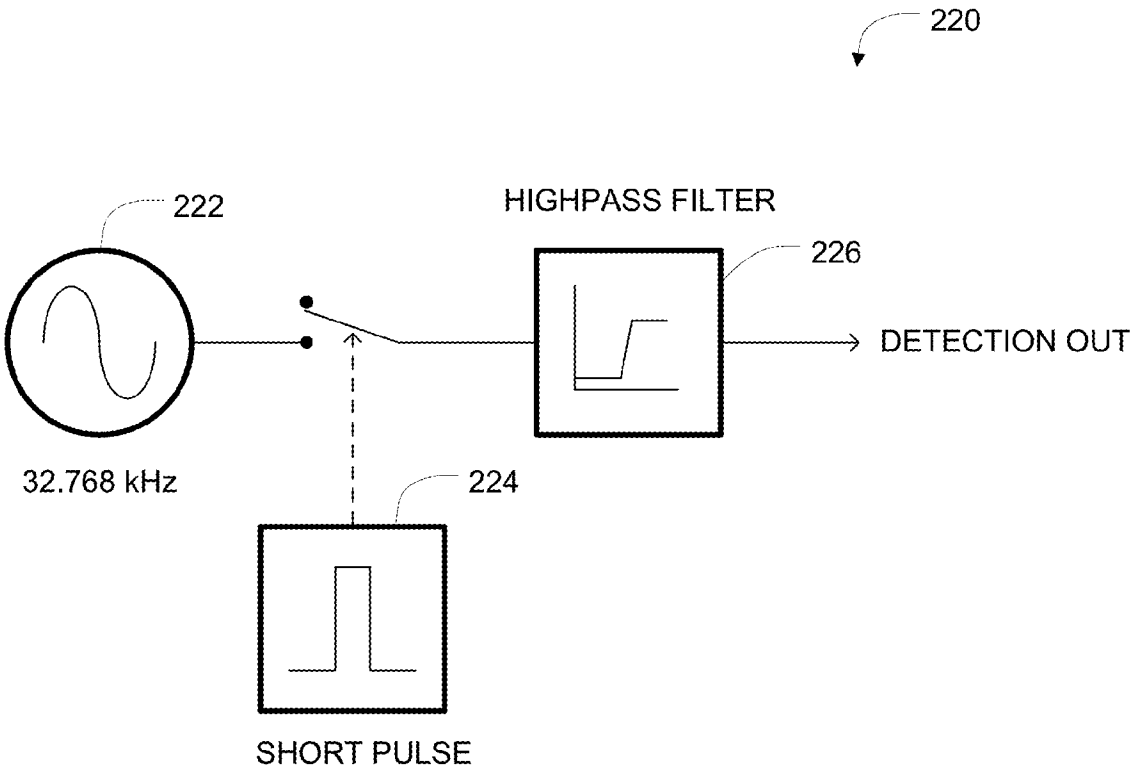
FIG. 7 is a schematic of a method of spectrally shaping a detection pulse using a high-pass filter.

In some embodiments, as shown in FIG. 7 for example, according to another method 220 spectral shaping can be performed by a highpass filter 226 located on the electronic device (e.g., the electronic device 12). In particular, a high frequency voltage source 222 can gated by a switch controlled by a short pulse generator 224, which is then filtered by the highpass filter 226 to be generally inaudible.

In this manner, those portions of the generated pulse with frequencies within the audible frequency range can be suppressed (or even eliminated). For example, the highpass filter could have a cutoff frequency above 20 kHz (or above 25 kHz, or even above 30 kHz) so that only energy above this threshold is sent to the audio accessory. The detection pulse should therefore be at least substantially inaudible to a human being.

It is generally desirable that the detection pulse be modulated at a frequency that is outside the human audible frequency range, while at the same time be sufficiently long such that the speakers inside the accessory will settle to a stable current when a voltage is applied thereto. This usually happens after a transient period of approximately 12 microseconds (at most), and in some cases much less time is required.

Therefore, with some tolerance, a pulse with a half-period of 15 microseconds could be used, which fits particularly well with a frequency of 32.768 kHz (a common oscillation frequency of components in many electronic devices), since this is within the desired frequency range (e.g., above 20 kHz), is very accurate, and may enable low power operation of the electronic device while detection is being accomplished.

There may be some design limitations that present challenges to implementing this third approach. For example, the finite attenuation of real-world high-pass filters and the limited resolutions and lengths of the shaped detection pulses may result in a small amount of energy still leaking though in the audible frequency range.

One further limitation is that it is desirable to have short detection times both from a user experience point of view, but also since very long sequences will tend to be more complicated to implement. Moreover, the risk of audio artifacts (e.g., clicks and pops) during insertion of the accessory rises in partial insertion scenarios, where the detection starts after the accessory has been partially inserted and the user subsequently completes the full insertion of the audio plug.

In such cases, the user may fully connect the audio accessory only after the detection has started, and there will be a chance that am electrical connection is made in the middle of a detection sequence, starting the sequence at high amplitude. In this scenario, the initial transient may be audible as an audio artifact.

With proper design, however, it should be possible to adjust the energy content within the audible frequency range to amplitudes below the human hearing threshold (e.g., below the curve 80 as shown in FIG. 5) and thereby tend to make the detection pulse truly inaudible even within practical constraints.

Figure 8:
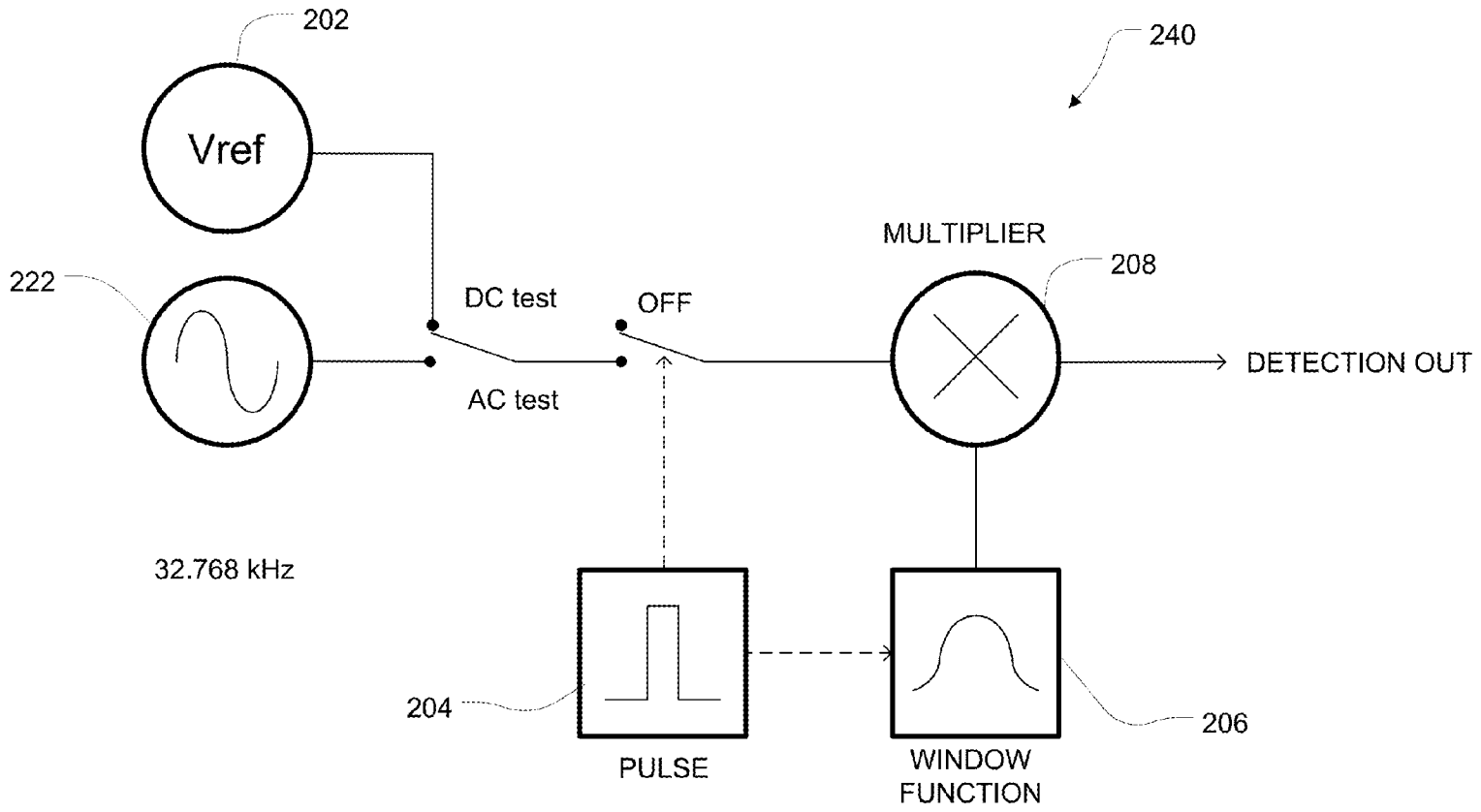
FIG. 8 is a schematic of another method of spectrally shaping a detection pulse.

In some embodiments, the method 200 of FIG. 6 and the method 220 of FIG. 7 may be combined into a method 240 as shown in FIG. 8, which can allow for the selection of either a DC test (e.g., using the DC voltage source 202) or an AC test (e.g., using the high frequency voltage source 222). This embodiment may be particularly useful as it may allow different detection pulses to be sent under different circumstances, for instance for testing of DC and AC coupled loads.

Turning back to FIG. 2, illustrated therein is a schematic diagram comparing the audibility of detection pulses, including an unshaped detection pulse 60 and a shaped detection pulse 62, according to one embodiment. As shown, the unshaped detection pulse 60 includes a significant portion of energy within the audible frequency range (e.g., between 20 Hz and 20,000 Hz), although a portion of the pulse 60 is above the upper frequency threshold 70 of the audible frequency range (i.e. a portion of the pulse 60 is at a frequency above 20,000 Hz).

However, for the shaped detection pulse 62, a significant portion of the energy in the audible frequency range has been suppressed (i.e. the shaped detection pulse 62 at least substantially excludes frequency components within the human audible frequency range). In particular, as evident by visual inspection the portion of the shaped detection pulse 62 below the upper threshold 70 is much smaller as compared to the unshaped detection pulse 60. Thus, the shaped detection pulse 62 should create far fewer audible artifacts as compared to the unshaped pulse 60.

Furthermore, if the amplitudes of those portions of the shaped detection pulse 62 within the audible frequency range are below the human threshold for hearing (e.g., below curve 80, with energies above the curve 80 being at least substantially excluded), then the entire shaped detection pulse 62 should be inaudible to a human user.

In some embodiments, with design effort and using a short filter order, it may be possible to attenuate the energy content within the audible frequency range by as much as 30 to 40 dB, thereby making the noise lower than usual background noise, and if possible lower than the human hearing threshold curve 80 (i.e. so that energies above the threshold curve 80 are substantially excluded).

As one specific example, the sequence {2, −6, 12, −18, 21, −18, 12, −6, 2} (representing the filter coefficients of a 8-th order finite impulse response (FIR) filter) will give significantly lower audible acoustic output as compared to a single sequence filter (assuming the same energy output).

In some embodiments, if the waveform is implemented using a modulated square wave, this can be done using a current source, with five resistors of values {2, 6, 12, 18, 21} and switches to control which resistor value is chosen.

In another implementation, resistors with values {2, 3, 6, 12} can be used in combination to obtain the desired values, but with a smaller total area.

Similarly, another implementation could use a finite number of charged capacitors to represent the desired values.

Figure 2:
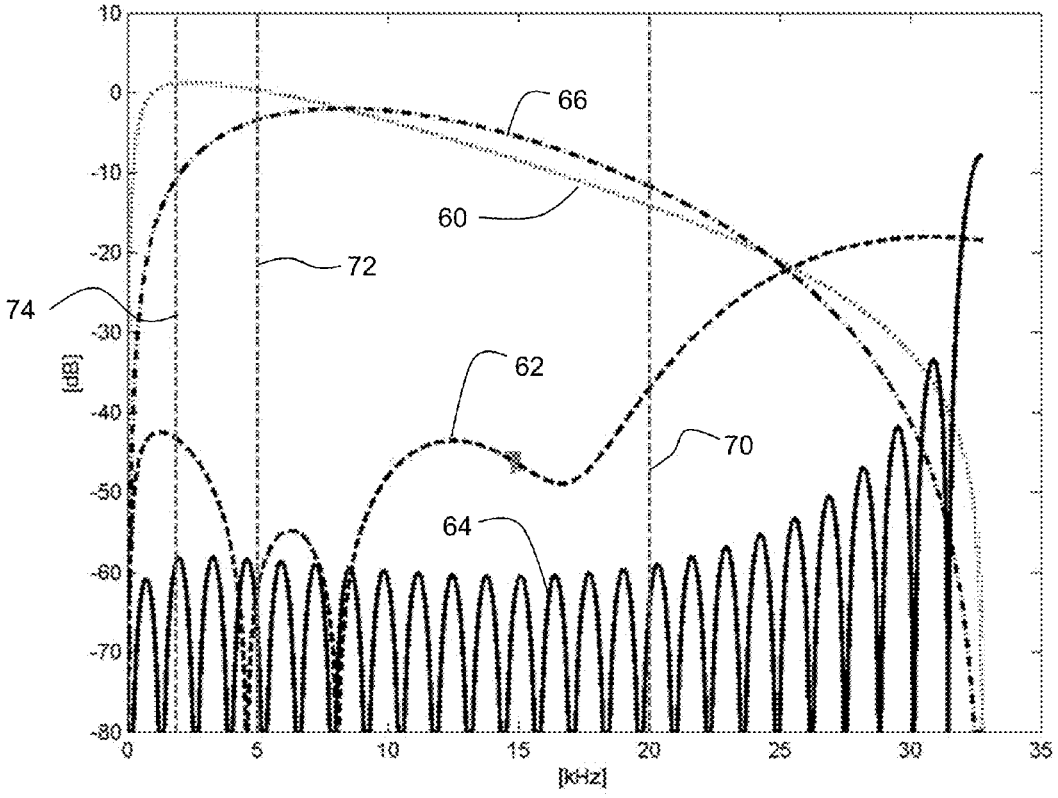
FIG. 2 is a diagram comparing the audibility of shaped detection pulses and non-shaped detection pulses.

In one embodiment, coefficients were found by designing a digital 10-th order highpass filter with a cutoff of 0.85 of the Nyquist limit (half the sample frequency) and quantized to finite values using rounding after multiplying with a factor of 100 (the two outermost coefficients became zero). The spectrum of this sequence is shown in FIG. 2 and labeled as curve 62 and compared to other sequences. The curves have been A-weighted when the spectrum was plotted and the energy for each pulse was normalized to be the same (A-weighting is an appropriate filtering for this curve, since the amplitude is of low value). This means that the curves represent the disturbance of each pulse as compared to each other, in different frequency bands while taking the sensitivity of the human ear into account.

The unshaped pulse 60 shows the spectrum of a monopolar pulse and while curve 66 shows the spectrum of a bipolar pulse. As evident by visual inspection, the use of the bipolar pulse 66 results in some attenuation of the audible spectrum below 5 kHz in the range of 10-30 dB, though there is less difference above 5 kHz.

A detection pulse using 9 coefficients and labeled as shaped pulse 62 shows an attenuation of more than 30 dB up to about 17 kHz, and considerable attenuation between 17 kHz up to 20 kHz.

Curve 64 on the other hand shows the results of a longer sequence, in this case a triangular window that is modulated by a square wave with 99 taps (resulting in the sequence $\{1, -2, +3, -4, \ldots, 49, -50, 49, \ldots -2, 1\}$. It is well known that the triangular window has significant sidelobes. However, this technique may be relatively simple to implement in hardware and the spectral curve 64 shows a very significant attenuation of spectral leakage as compared to the other curves, showing the advantages of using longer sequences.

Figure 3:
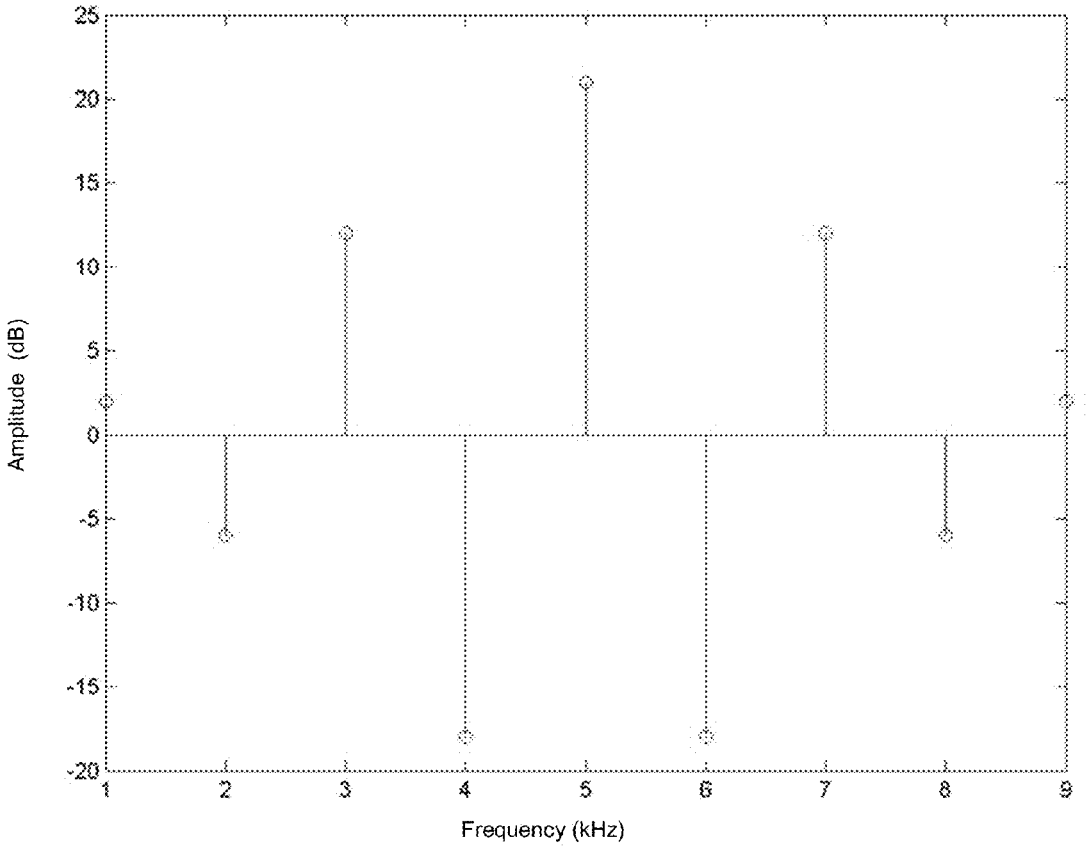
FIG. 3 is a stem plot of an exemplary sequence.

In general, effective attenuation of audible effects can be obtained by multiplying a high frequency periodic sequence outside the audible bandwidth (e.g., a sine or a square wave) with a window function (e.g., a Gaussian window) or by shaping a detection pulse with a filter. These methods have been confirmed with both listening tests and quantitative measurements. Specifically, an exemplary sequence was fed to a D/A converter (DAC) and compared against a monopole and bipolar square impulse. The result was significant reductions in the perceived acoustic noise, even though all three pulses were scaled to have same maximum amplitude. The stem plot of the example sequence is shown in FIG. 3. In some cases, the audio performance could be improved further by imposing the same output energy for all three pulses.

It should be noted that the shaped pulses were slightly longer in the time domain than the original pulses, but this should be of minor concern, since the extra delays are on the order of fractions of a millisecond.

However, if longer sequences are used (e.g., 50-200 samples), the delay could be up to one millisecond or longer, which could add significant detection delays, particularly if multiple pulses are used to test different impedances and different configurations.

In some embodiments, multiple pulses may be used in order to check for different impedance values. For instance, a generator with a high output impedance may be used to test high impedance loads, while a lower output impedance may be used to test lower impedance loads. This scheme may be used to reduce the errors made when making electrical measurements of particular audio accessories.

One advantage of the longer detection pulses is a further reduction of spectral leakage, thereby making the pulses fully inaudible. In addition, quantitative measurements showed more than 30 dB of attenuation using this approach as compared to an unshaped pulse.

In some embodiments, the systems and methods as described herein can be implemented as part of a custom hardware (e.g., an ASIC or other circuit) that can handle jack detection. Such a custom circuit may require minimal extra silicon area on the electronic device, thereby making it cost effective and realistic to implement.

In some embodiments, a detection circuit can be made using an array of charged capacitors of various sizes (or as an array of resistors of various values) that store the desired waveform so that it can be generated when desired. Accordingly, it may not be necessary to implement a digital memory and a digital-analog converter (DAC) in order to carry out some of the spectral shaping methods as generally described herein.

In some embodiments, the teachings herein may be implemented using one or more highpass filter (e.g., an analog filter, or digital filter, or both), and in such cases the pulse waveform need not be stored. The suitability of this approach may depend on the spectral characteristics of the available filtering technologies.

In some cases, in order to obtain a desired signal-to-noise ratio (SNR) for the detection pulse, and obtain accurate results, one approach may be to use matched filtering when receiving the transmitted detection pulse back at the electronic device. In this manner, the influence of noise can be reduced, thereby improving the sensitivity of the detection method.

Figure 10:
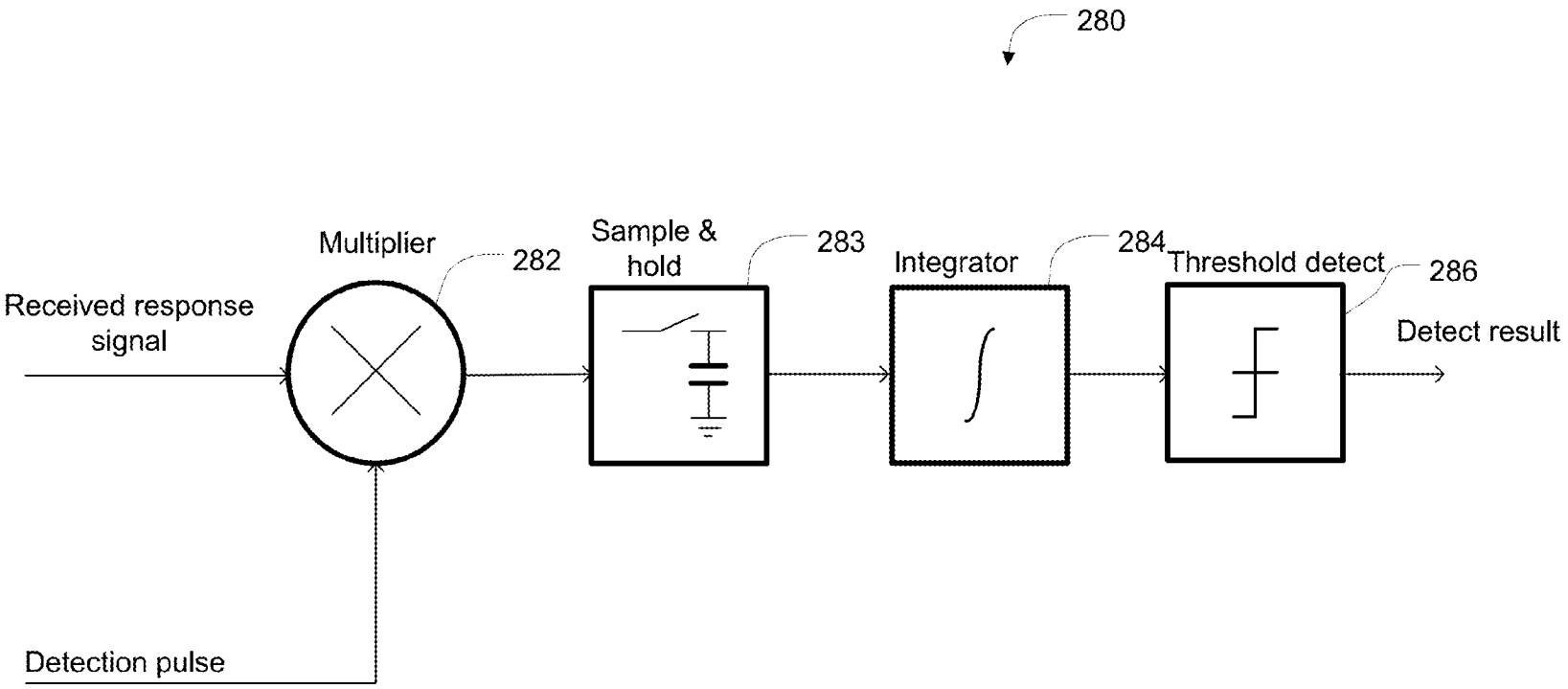
FIG. 10 is a method of analyzing a response signal according to one embodiment.

For example, FIG. 10 shows a schematic of a method 280 that includes multiplying the received response signal and the detection pulse (e.g., using a multiplier 282). It is generally beneficial that the signal is sampled after the initial transient has died out to avoid errors due to additional capacitance and inductance in the system and from the accessory.

Therefore, a received detection signal should be sampled at a suitable time using sampler 283. For example, if a resistive measurement is desired, then the sampling should be done at the end of each step value. The resulting signal may then be integrated (e.g., using an integrator 284).

In some embodiments, the integrated signal may then pass through a threshold detector 286 before the resulting signal is used to determine the impedance of the observed audio accessory.

In some embodiments, detection could be implemented by multiplying the received pulse with the original waveform, sampling at the correct time, integrating this pulse shape and using the final integrated value for a threshold detector.

In some embodiments, it may be possible to transmit the shaped detection pulse twice, with the second pulse having an inverted amplitude as compared to the first pulse. By subtracting these two detection pulses, any external influences of noise at lower frequencies should be cancelled, thereby making the detection methods more robust.

In some embodiments, it may be possible to transmit the shaped detection pulses multiple times with different polarities or different shapes (or both) in order to remove noise in specific sensitive frequency bands.

In some embodiments, the received pulses should be gated, and pulses with a certain length should be used in order to make sure the received pulses have fully settled before taking a measurement. Typically a settling time of 15 microseconds or longer may be enough for some audio accessories, such as headsets and headphones. By combining finite pulses with spectral shaping, detection of audio accessories can be done in a generally inaudible manner.

Figure 4:
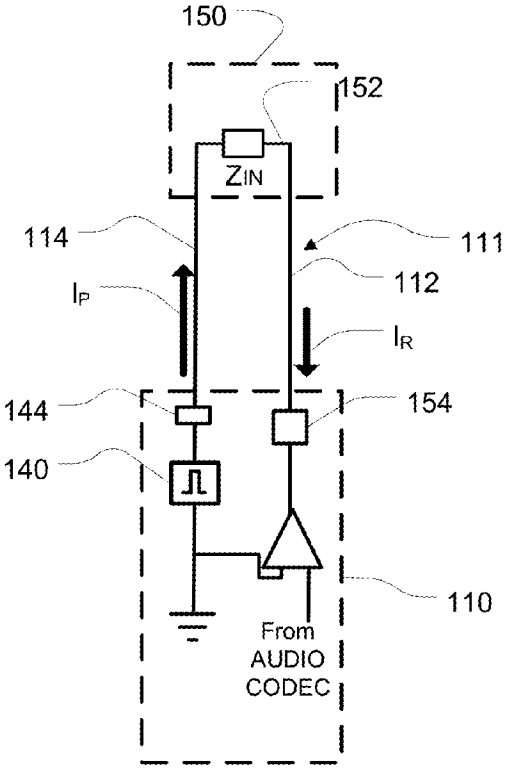
FIG. 4 is a schematic representation of an electronic device and audio accessory according to another embodiment.

Turning now to FIG. 4, illustrated therein is an electronic device 110 and audio accessory 150 according to one embodiment. As discussed above, the electronic device 110 may be adapted to detect whether a particular audio accessory 150 is coupled to the electronic device 110 by monitoring an impedance detected by the electronic device 110 through an audio jack 111, with spectral shaping being used to ensure that the detection pulse is generally inaudible and generally does not cause undesired audio artifacts.

Similar to as in FIG. 1, the audio accessory 150 may include one or more speakers. In this embodiment, the input impedance between two pins of the accessory, $Z_{IN}$ 152 represents one or more speakers. In other cases $Z_{IN}$ may represent a microphone or the input impedance of an amplifier or some other component.

In this embodiment, the electronic device 110 is adapted to generate a shaped detection pulse $I_P$ on a ground return line 114 of the audio jack 111. For example, depending on the particular configuration of the audio jack 111, the shaped detection pulse $I_P$ can be applied to the SLEEVE of a TRS jack, or RING2 and SLEEVE in a TRRS jack, or to the TIP or RING1.

As shown, the pulse $I_P$ could be generated in a raw or unshaped format by a pulse generator 140, and then filtered by a high pass filter 144 to obtain a desired waveform (e.g., with at least a substantial portion of the energy content located outside the audible frequency range).

In some embodiments, the shaped detection pulse $I_P$ is a voltage pulse, which could for example be generated by a voltage source that is coupled to, or part of, the pulse generator 140.

In some embodiments, the shaped pulse $I_P$ may have a magnitude of between about −50 mV to +50 mV.

The shaped detection pulse $I_P$ is sent to the audio accessory 150 and returns back to the electronic device 110 (in this embodiment) via the audio line 114 as a response signal $I_R$ that is indicative of the impedance of the audio accessory 150. As shown, in this embodiment the response signal $I_R$ is monitored by a detector 154 on the electronic device 110.

In some embodiments, during an impedance measurement, the amplifier 110 may be tri-stated in order not to disturb the measurement.

In some embodiments, a headphone amplifier may be used to directly output the detection pulse.

The electronic device 110 can then compare the measured response signal $I_R$ to known impedance values for known audio accessories in order to identify the particular audio accessory 150 (i.e. known impedance values for known audio accessories may be stored in a memory).

In some embodiments, a plurality of shaped detection pulses $I_P$ can be sent to the audio accessory to validate the measured impedance. In some embodiments, the plurality of shaped detection pulses $I_P$ generate a plurality of response signals $I_R$ that can be averaged to determine an averaged impedance.

Depending on what audio accessory 150 is detected by the electronic device 110, the electronic device 110 can take one or more actions. For instance, the electronic device 110 may compensate for or take advantage of different functions and capabilities of the particular audio accessory 150. In some examples, the electronic device 110 can adjust audio output volume sent over the audio line 114 of the jack 111 for high output audio accessories, can disable the microphone line when a microphone is not present, can output only mono audio when a mono-only audio accessory is detected, and so on.

Returning again to FIG. 5, as shown the lower threshold curve 80 defines the minimum audibility curve for humans. It is evident by visual inspection that there is significant variation in the sensitivity of the average human being to sound intensity depending on the frequency of the sound. For instance, within the audible frequency range, the human ear is especially sensitive to frequencies between 300 Hz and 6 kHz, and even more sensitive to frequencies between 2 kHz and 5 kHz.

This suggests that the spectral leakage within these frequency bands should be limited more than in other frequency bands of the audible range. In particular, if the second approach for generating a detection pulse is used, it may be desirable to add extra attenuation (e.g., by using a bandstop filter) to this range of frequencies.

Sounds within the more sensitive frequency ranges will normally be perceived by a human being as being louder than sounds falling outside of the sensitive frequency ranges, even when objectively the sound intensity is the same.

Thus, in some embodiments, particularly in real-world embodiments using real filters, the spectral shaping of the detection pulse can be configured to particularly reduce the signal amplitude between 300 Hz and 6 kHz, and more particularly between 2 kHz and 5 kHz.

For example, as shown in FIG. 2, the shaped detection pulse 62 has a generally low energy between the two thresholds 74 and 72 corresponding to 2 kHz and 5 kHz ranges, respectively. Thus, in practical terms, detection of this shaped detection pulse 62 may be very difficult for a human user.

In general, by shaping a detection pulse with energies that are either outside of the audible frequency range (e.g., either above or below) or below the threshold curve 80 for human sensitivity, or some combination thereof, it may be possible to detect what particular audio accessories are coupled to the electronic device in a generally inaudible manner.

The foregoing aspects of the method and the electronic device are provided for exemplary purposes only. Those skilled in the art will recognize that various changes may be made thereto without departing from the scope of the, systems, methods and electronic devices that may be defined by the appended claims.

The invention claimed is:

1. A method for identifying an audio accessory coupled to an electronic device, comprising:

applying at least one detection pulse to the accessory over an audio jack, each detection pulse excluding at least one of:

energies that are above a lower audible human threshold, and frequency components within the human audible frequency range so as to be inaudible to a human;

receiving at the electronic device at least one response signal from the audio accessory, each response signal corresponding to a detection pulse;

wherein each detection pulse is sufficiently long such that the at least one response signal will settle to a stable current;

measuring the at least one response signal after it has settled to determine an impedance of the audio accessory; and based on the determined impedance, identifying the audio accessory as a particular audio accessory.

2. A method for identifying an audio accessory coupled to an electronic device, comprising:

applying at least one detection pulse to the audio accessory, each detection pulse being spectrally shaped to be inaudible to a human user;

receiving at least one response signal corresponding to each detection pulse that is indicative of the impedance of the accessory; and based on the impedance, identifying the accessory.

3. The method of claim 2, wherein the shaped detection pulse includes a low frequency detection pulse.

4. The method of claim 3, wherein the low frequency detection pulse has an energy content that is below an audible frequency range.

5. The method of claim 2, wherein the shaped detection pulse excludes energies above a lower audible human threshold.

6. The method of claim 5, wherein the shaped detection pulse includes a portion within the human audible frequency range.

7. The method of claim 2, wherein the shaped detection pulse includes a high-frequency detection pulse.

8. The method of claim 7, wherein the high-frequency detection pulse has an energy content that is above an audible frequency range.

9. The method of claim 7, wherein the shape of the detection pulse is stored in hardware.

10. The method of claim 7, wherein the detection pulse is shaped using a highpass filter located between a pulse generator on the electronic device and the audio accessory.

11. The method of claim 10, wherein the highpass filter has a cutoff frequency above 20 kHz.

12. The method of claim 10, wherein at least a portion of the shaped detection pulse leaks though the highpass filter into the audible frequency range.

13. The method of claim 12, wherein the leaked portion is shaped to be below the lower audible human threshold.

14. The method of claim 2, further comprising applying matched filtering to the response signal to reduce the influence of noise.

15. The method of claim 2, wherein the at least one shaped detection pulse includes a plurality of shaped detection pulses.

16. The method of claim 15, wherein the plurality of shaped detection pulses generate a plurality of response signals, and the plurality of response signals are averaged to determine the impedance.

17. The method of claim 15, wherein at least one of the shaped detection pulses has inverted amplitude and is subtracted from another shaped detection pulse to reduce the influence of noise.

18. The method of claim 2, wherein the response signal is settled before the impedance is measured.

19. The method of claim 2, wherein the shaped detection pulse excludes energies that are above the lower audible human threshold, and frequency components within the human audible frequency range.

20. An electronic device for identifying an audio accessory coupled thereto, comprising:

a pulse generator that generates at least one detection pulse and applied the detection pulse to an audio accessory over an audio jack, each detection pulse being spectrally shaped to be generally inaudible to a human user; and a detector for receiving at least one response signal corresponding, each response signal corresponding to one of the at least one detections pulse and being indicative of the impedance of the audio accessory, wherein the audio accessory is identified as a particular audio accessory based on the impedance detected by said detector.

* * * * *